US005124900A

United States Patent [19]

Varey et al.

[11] Patent Number: 5,124,900

[45] Date of Patent: Jun. 23, 1992

[54] LIGHT DIFFUSER

[75] Inventors: Douglas Varey; Harold H. Kawaguchi; Brent E. Markee, all of Seattle, Wash.

[73] Assignee: Manifesto Corporation, Seattle, Wash.

[21] Appl. No.: 441,999

[22] Filed: Nov. 28, 1989

[51] Int. Cl.[5] ..... F21V 1/06

[52] U.S. Cl. ..... 362/352; 362/351; 362/355; 362/360; 428/902

[58] Field of Search ..... 362/351, 355, 356, 360, 362/352, 358; 428/902, 287, 351, 360

[56] References Cited

U.S. PATENT DOCUMENTS

| | | | |
|---|---|---|---|
| 1,220,562 | 3/1917 | Ronayne . | |
| 1,868,776 | 7/1932 | Tate | 362/360 |
| 1,929,315 | 10/1933 | Johnson et al. | 240/108 |
| 3,194,959 | 7/1965 | Bashaw et al. | 240/108 |
| 3,888,821 | 6/1975 | Milford, Jr. | 264/182 |
| 3,895,229 | 7/1975 | Strom | 362/351 |
| 4,029,955 | 6/1977 | Tart | 428/280 X |
| 4,091,137 | 5/1978 | Miller | 428/280 X |
| 4,117,532 | 9/1978 | Arbib | 362/358 |
| 4,229,680 | 10/1980 | Berlin, Jr. et al. | 315/71 |
| 4,331,169 | 5/1982 | Bonser | 135/89 |
| 4,505,100 | 3/1985 | Yoshiyuki et al. | 57/328 |
| 4,539,631 | 9/1985 | Lieberman | 362/355 X |
| 4,605,996 | 8/1986 | Payne | 362/352 |
| 4,668,234 | 5/1987 | Vance et al. | 8/538 X |
| 4,710,432 | 12/1987 | Nishimura et al. | 428/288 X |
| 4,747,031 | 5/1988 | Huang | 362/360 |
| 4,858,547 | 8/1989 | Sternlieb | 428/287 |
| 4,897,301 | 1/1990 | Uno et al. | 428/902 |
| 4,919,869 | 4/1990 | Zalkulak et al. | 264/78 |

OTHER PUBLICATIONS

Product Brochure for TINUVIN ®1130, "Liquid Ultraviolet Light Absorber for Coatings"; Ciba Geigy Corporation.

Product Brochure for NOMEX ®, Aramid Paper and Pressboard; DuPont Company.

*Primary Examiner*—Ira S. Lazarus
*Assistant Examiner*—Y. Quach
*Attorney, Agent, or Firm*—Christensen, O'Connor, Johnson & Kindness

[57] ABSTRACT

Sheets (26, 28, 30, 32) of aromatic polyamide polymer fibers are folded or formed into various shapes and constructions and used as light diffusers on lamps. The light diffusers are resistant to combustion which allows them to be placed closer to the light source. The diffusers are translucent and provide an appearance similar to parchment or rice paper.

17 Claims, 5 Drawing Sheets

LIGHT DIFFUSER

FIELD OF THE INVENTION

The present invention relates to light diffusers particularly for use as light shades or lamp shades.

BACKGROUND OF THE INVENTION

Parchment and rice paper are natural fibers used in the design of light diffusers for lamps and other lighting fixtures. The parchment and rice paper serve as a translucent medium for diffusing light from the light source, be it incandescent or fluorescent. Although parchment or rice paper provide an aesthetically pleasing effect, over time, the effect deteriorates due to embrittlement and discoloration. Furthermore, the delicate nature of parchment and rice paper make them susceptible to damage due to cleaning or other handling and moisture. Also, lamp shades made from parchment, rice paper, or other flammable materials must be spaced from the light source a distance sufficient to prevent combustion of the shade. Unfortunately, this spacing is not always compatible with the design and placement of the shade relative to the source of light.

SUMMARY OF THE INVENTION

Light diffusers or shades formed in accordance with the present invention include a sheet of aromatic polyamide polymer fibers. The diffusers provide a visual effect similar to those made from parchment or rice paper. Diffusers formed in accordance with the present invention are not susceptible to combustion if placed close to the source of light. The shades are translucent and can be formed into many different shapes and multipiece constructions. The materials used to form the diffusers in accordance with the present invention are resistant to moisture damage and do not tear easily.

In an additional embodiment, the diffusers are treated to resist discoloration.

In another embodiment, a light diffuser formed in accordance with the present invention includes a sandwich construction for added structural integrity, such as resistance to warping or wrinkling.

BRIEF DESCRIPTION OF THE DRAWINGS

A better understanding of the present invention can be derived by reading the ensuing specification in conjunction with the accompanying drawings wherein.

DETAILED DESCRIPTION OF THE INVENTION

Figure 1:
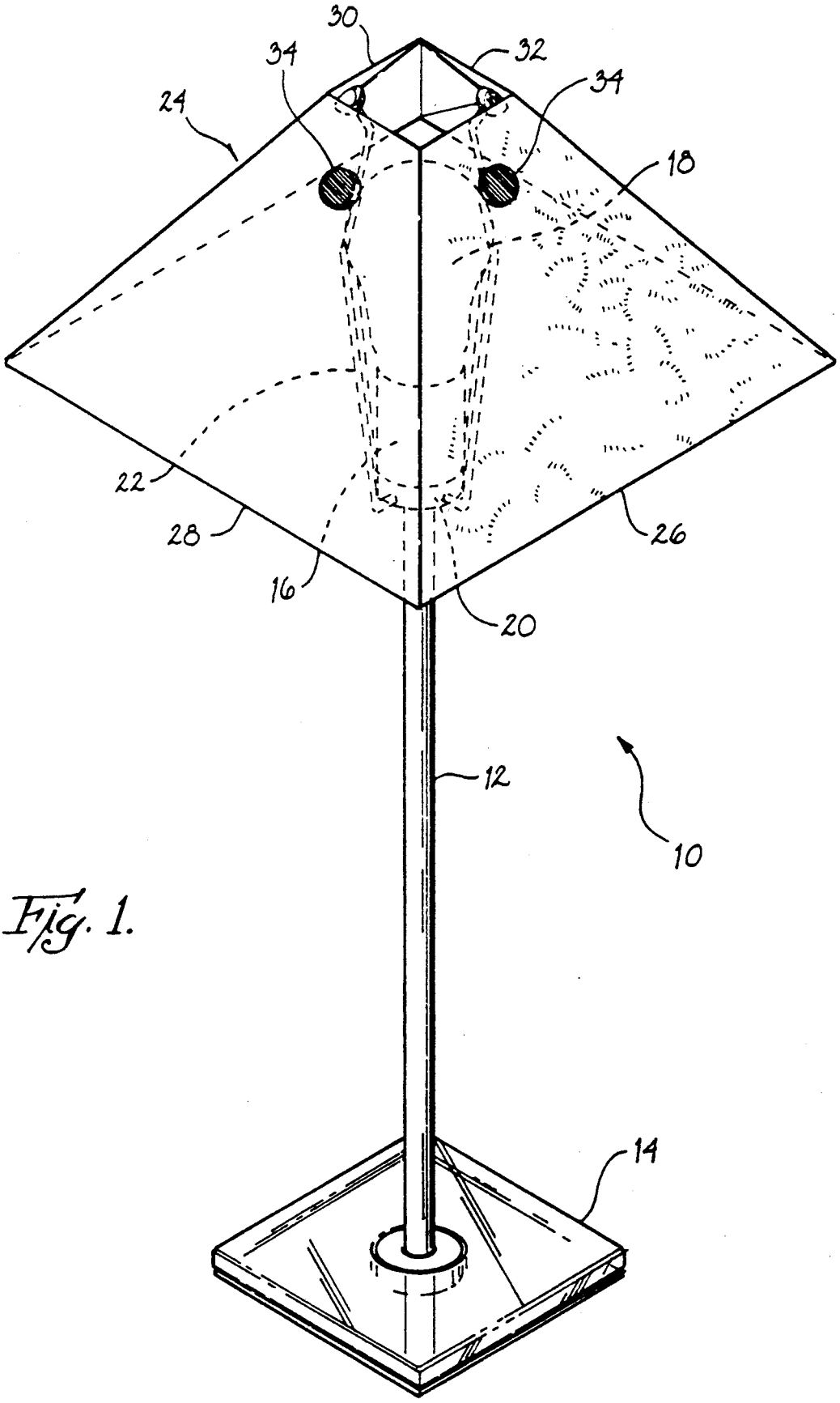
FIG. 1 is an isometric view of a light diffuser formed in accordance with the present invention on a lamp stand.
Figure 2:
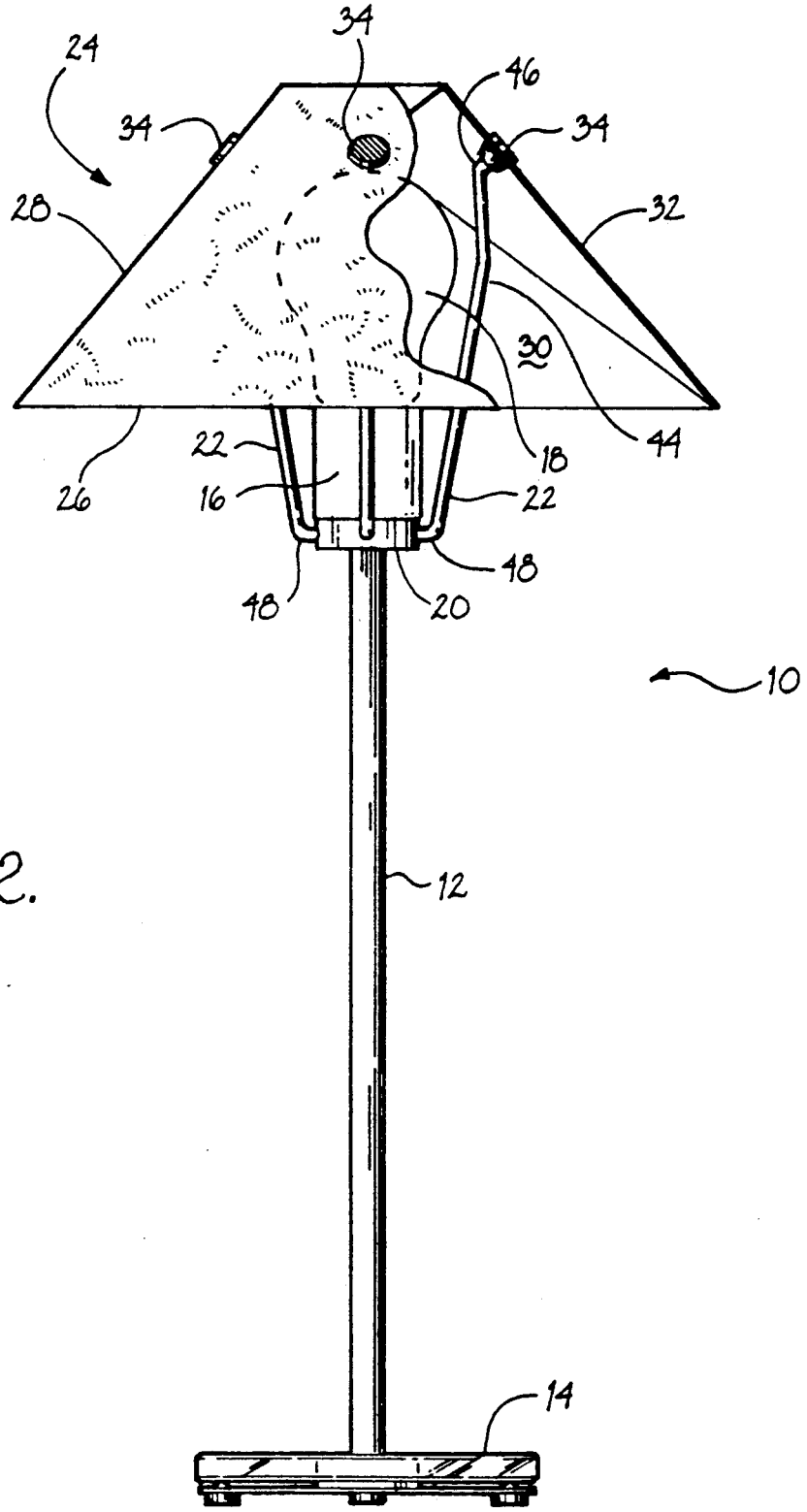
FIG. 2 is an elevational view of the side of the light diffuser and lamp stand in FIG. 1.
Figure 3:
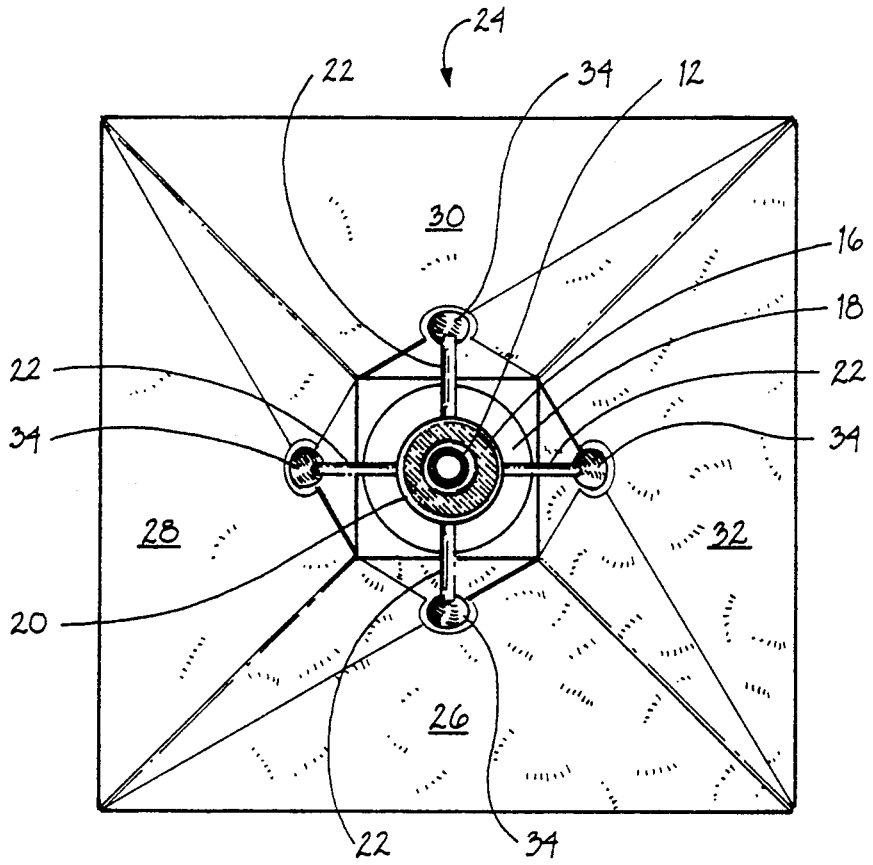
FIG. 3 is a plan view of the top of the light diffuser and lamp stand in FIG. 1.
Figure 4:
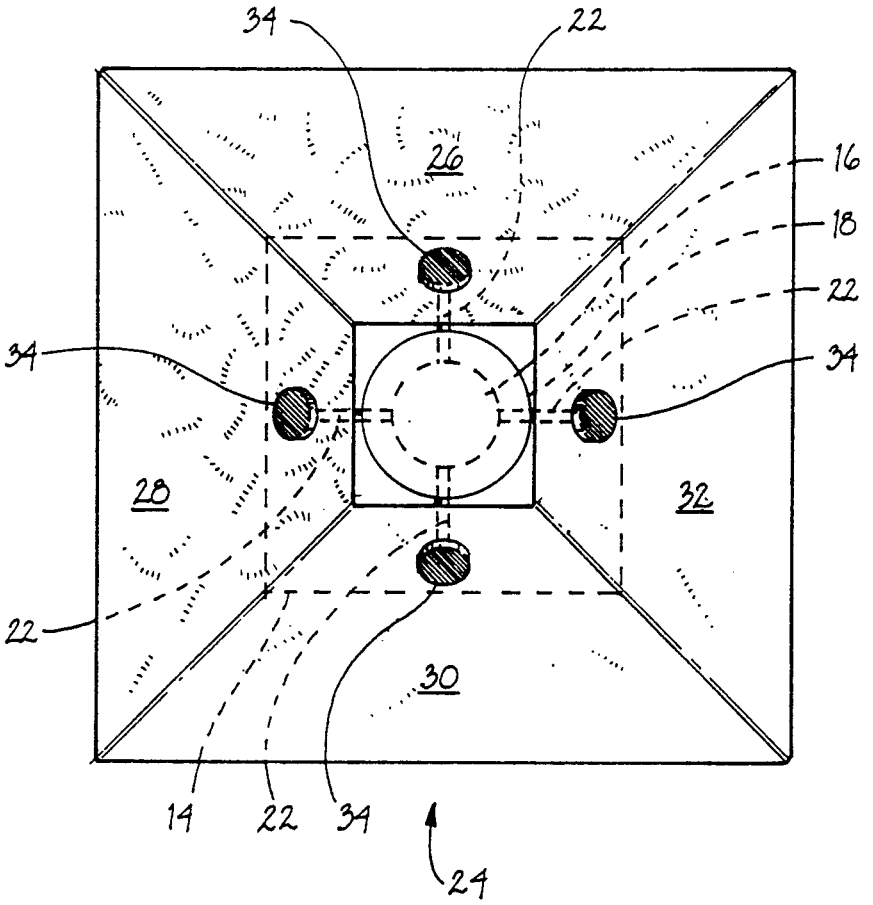
FIG. 4 is a plan view of the bottom of the light diffuser taken above the base of the light stand in FIG. 1.

Referring to FIGS. 1, 2, 3, and 4, a light diffuser 24 formed in accordance with the present invention can be used in conjunction with a lamp 10 that includes a vertical stem 12 that is supported by a horizontal base represented by reference numeral 14. It should be understood that, depending upon the length of stem 12, the lamp can be used as a floor lamp or a desk/table lamp. A conventional electrical socket 16 for a light bulb 18 is positioned on the upper end of stem 12 opposite base 14. Immediately below socket 16 attached to stem 12 is a collar 20 for retaining and supporting vertically and outwardly extending support arms 22. Support arms 22 are used to support diffuser 24 around bulb 18, as described hereinbelow in more detail. Diffuser 24 preferably includes four quarter sections indicated by reference numerals 26, 28, 30, and 32. Each quarter section is adapted to receive and retain at least one fastener 34 capable of being attached to one support arm 22. It should be understood that the present invention is not limited to quarter sections. Diffusers having more than four sections or fewer than four sections can also be formed in accordance with the present invention. The cooperation between support arms 22 and fasteners 34 serve to position and hold diffuser 24 around bulb 18.

Referring primarily to FIG. 1, diffuser 24 can be in the shape of a truncated pyramid. It should be understood that the configuration of diffuser 24 as illustrated in FIGS. 1–4, is one example of the many different shapes and constructions of light shades that can be formed in accordance with the present invention.

Light diffusers formed in accordance with the present invention are made from folded or shaped sheets of aromatic polyamide polymer fibers. The sheets of aromatic polyamide polymer consist of short fibers or floc of aromatic polyamide polymer and microscopic filmy particles or fibrids of the polymer. The fibers serve to provide mechanical strength to the sheet and the fibrids serve as a binder and filler. The sheets are formed by paper-making methods that cause the fibrids to form filmy webs between the fibers. Generally, the sheets are densified at high temperature and pressure to lock the fibers and fibrids together. The aromatic polyamide polymers can be derived from p-phenylenediamine and terephthaloylchloride. Papers and pressboards of aromatic polyamide polymer fibers are commercially available under the name NOMEX ® Type 410 and the like from E.I. DuPont de Nemours Company. The paper and pressboard sheets are available in various thicknesses ranging from about 2 mils (one-thousandth of an inch) to about 30 mils. For diffusers formed in accordance with the present invention, sheets of aromatic polyamide polymer fibers ranging in thickness from about 3.0 mils to about 7.0 mils are preferred for their flexibility and translucency.

The sheets of aromatic polyamide polymer fibers are thermally stable up to temperatures of 200° C. so they are not susceptible to combustion when placed close to a source of light. The sheets are generally resistant to moisture which allows them to be cleaned easily without damage, although some warping may occur as a result of moisture entering the cut edges of the sheet as described hereinbelow in more detail. The sheets are strong and resilient which reduces their susceptibility to tearing and abrasion, while being flexible enough to allow sharp and easy creasing if desired. In addition to being capable of being creased along sharp lines, the flexibility of the sheets of aromatic polyamide polymer fibers allows them to be wrapped or curved to form light diffusers without sharp creases. Furthermore, the sheets can be crumpled to provide a distressed appearance.

In accordance with the present invention, the aromatic polyamide polymer fiber sheets can be treated with ultraviolet light absorbers, such as substituted hydroxyphenyl benzotriazoles to reduce fading or discoloration. The ultraviolet light absorber used should be heat stable and preferably clear. An example of a liquid ultraviolet absorber of this type is available under the name TINUVIN TM 1130 from Ciba Geigy Corporation. The light absorber may be applied to the aromatic polyamide polymer fiber sheets by any convenient method, such as by spraying or screen printing.

Although the aromatic polyamide polymer fiber sheets do not tend to absorb water along their face, it has been observed that moisture may be absorbed along edges that have been cut. This absorption of water can cause the sheets to warp or wrinkle. Applicants have found that a composite of the aromatic polyamide polymer sheet and a polyester film, such as one available under the name MYLAR ® from E.I. DuPont deNemours Company, which does not absorb moisture, does not tend to warp or wrinkle in the matter of the separate sheets of the aromatic polyamide polymer fiber.

The composite of aromatic polyamide polymer fiber sheets and polyester film is preferably a sandwich of the polyester film between at least two sheets of the aromatic polyamide polymer fibers. Preferably, each of the polyamide sheets is about 3.0 mils thick and the sheet of polyester film is about 7.5 mils thick. However, other thicknesses may be used without departing from the scope of the present invention. The sandwich is constructed by laminating the three sheets together under pressure and heat using an adhesive. Because the polyester film does not tend to absorb moisture, it helps to prevent the aromatic polyamide polymer sheets from warping or otherwise distorting as a result of their absorption of moisture.

Figure 5:
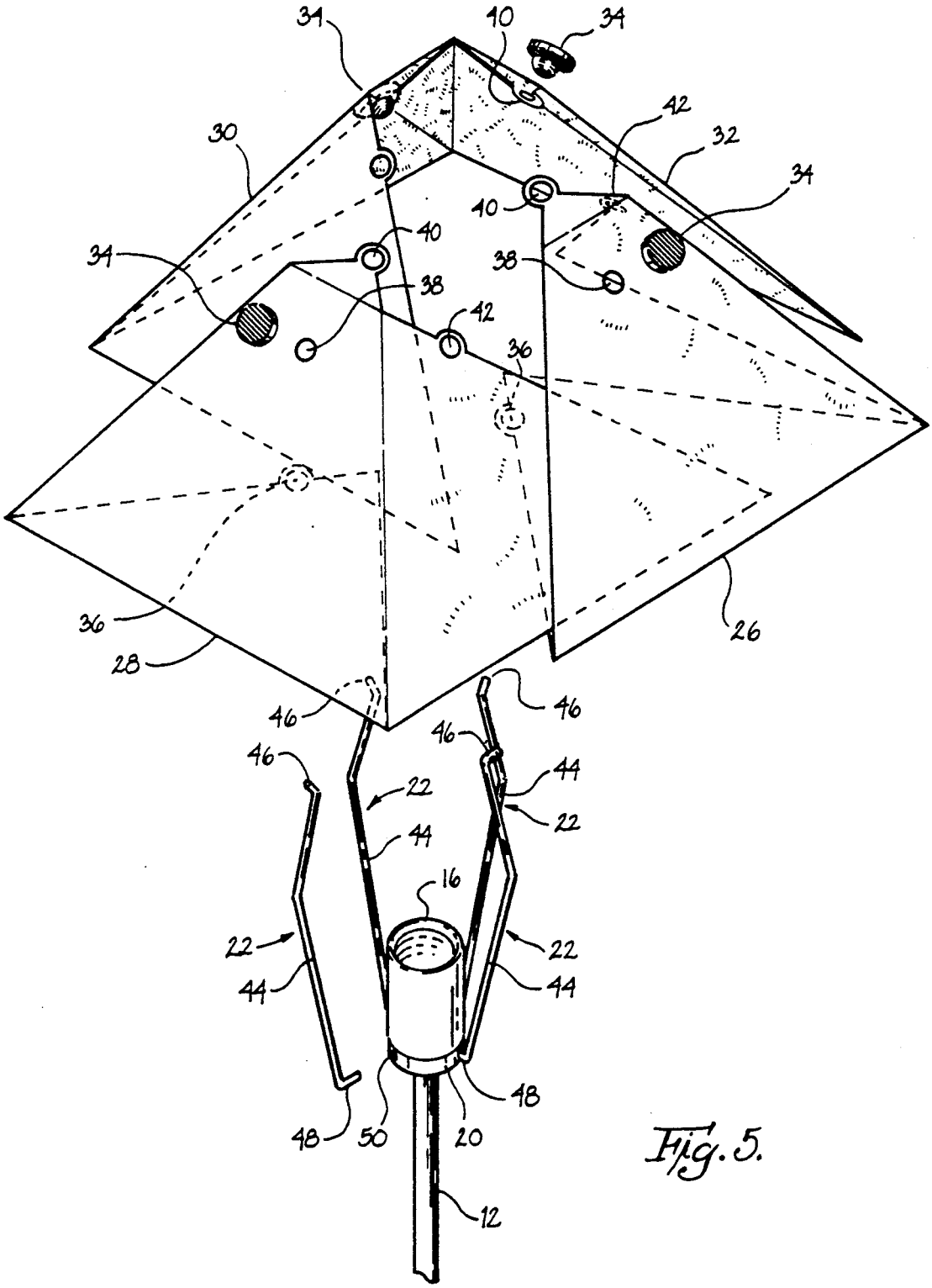
FIG. 5 is an isometric view of the light diffuser in FIG. 1 blown apart to illustrate the individual components.
Figure 6:
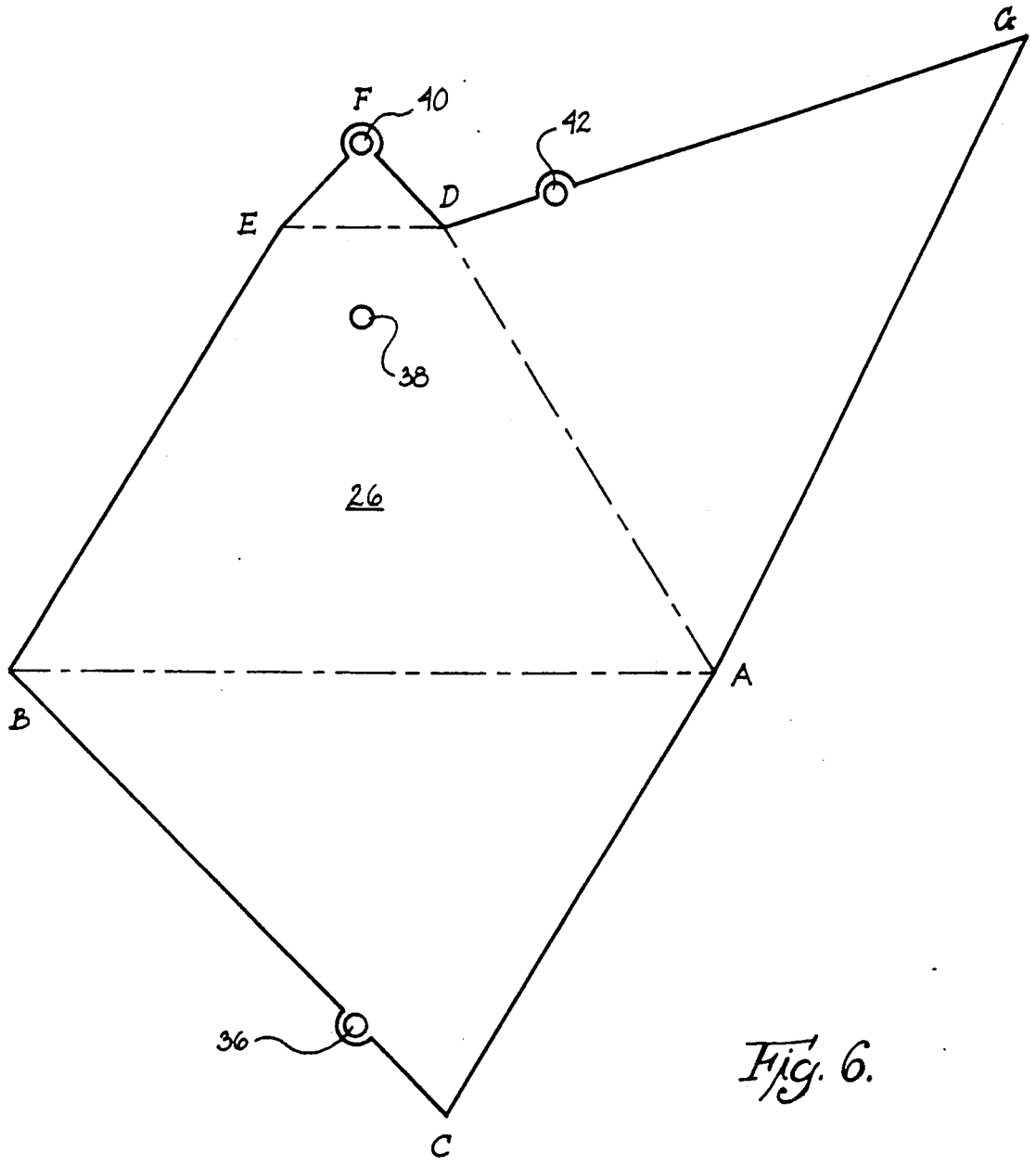
FIG. 6 is a plan view of the top of an unfolded quarter of the light diffuser in FIG. 5.

Referring to FIG. 5, diffuser 24 in FIG. 1 includes four quarter sections 26, 28, 30, and 32 that are blown apart and removed from support arms 22 for purposes of illustration. Sections 30 and 32 are folded in the configuration as they exist on the finished shade, sections 26 and 28 are partially unfolded to show the cooperation between adjacent sections (as well as each of the other sections 30 and 32). Additionally, referring to FIG. 6, section 26 comprises a single sheet of aromatic polyamide polymer fibers having the shape shown in FIG. 6. Each section includes: a base quadrangle ABED; a small upper triangle DEF extending from the top of quadrangle ABED and sharing a common boundary defined by fold line DE; a lower triangle ABC extending from and sharing the lower boundary defined by fold line AB of quadrangle ABED; and, an intermediate triangle ADG extending from and sharing the right-hand boundary defined by fold line AD of quadrangle ABED. The sections can be cut from larger sheets of aromatic polyamide polymer sheets by die cutting.

Section 26 is folded into its final shape for attachment to support arm 22 by folding lower triangle ABC along line AB over a portion of base quadrangle ABED, such that a lower hole 36 formed along edge BC coincides with a primary hole 38 formed in base quadrangle ABED adjacent fold line DE. As described in more detail below, before folding upper triangle DEF, intermediate triangle ADG of adjacent section 28 is slid between lower triangle ABC and quadrangle ABED so that intermediate hole 42 formed along edge DG of section 28 coincides with lower hole 36 and primary hole 38 of section 26. Upper triangle DEF is then folded along line DE so that it overlaps a portion of both base quadrangle ABED and lower triangle ABC of section 26, and intermediate triangle ADG of section 28 such that an upper hole 40 formed at the apex F of the upper triangle DEF coincides with lower hole 36 and primary hole 38 of section 26 and intermediate hole 42 of section 28. As described hereinbelow in more detail, the alignment of lower hole 36, primary hole 38, and upper hole 40 of section 26 with intermediate hole 42 of section 28 define a singular aperture for receiving and retaining fastener 34 in FIG. 5.

Intermediate triangle ADG of sections 26 and 28 is folded along line AD in the same direction (relative to the surface of quadrangle ABED) as upper triangle DEF and lower triangle ABC. However, triangle ADG does not overlap base quadrangle ABED, but rather, the plane defined by the intermediate triangle ADG forms an obtuse angle with the surface of quadrangle ABED such that when section 26 is affixed to support arm 22, intermediate triangle ADG of section 28 lies in the same plane defined by base quadrangle ABED of section 26. Likewise, intermediate triangle ADG of section 26 lies in the same plane as base quadrangle ABED of section 32 when attached to support arm 22. Accordingly, intermediate hole 42 of a section located counterclockwise of any section in FIG. 5 coincides with the congruence of lower hole 36, primary hole 38 and upper hole 40 of such section. The alignment of these holes allows one section, e.g. 28, to be fastened via fastener 34 to an adjacent section, e.g. 26 and support arm 22. Accordingly, each section is attached to the two adjacent sections to form the final shape of diffuser 24 shown in FIGS. 1–4.

Four support arms 22 serve to hold and position diffuser 24 around bulb 18. Each support arm 22 includes an elongated, formed shank member 44 having an upper, outwardly extending end 46 for receiving a fastener 34 that passes through the aligned lower hole 36, primary hole 38, and upper hole 40 in one section of diffuser 24. The opposite lower end of each support arm 22 includes a horizontal toe 48 extending inwardly for reception in one of four evenly spaced holes 50 around the periphery of collar 20. Each hole 50 is sized such that the toe 48 snugly fits therein. Collar 20 is attached to stem 12 and/or to the bottom of socket 16.

Light diffusers formed in accordance with the present invention from sheets of aromatic polyamide polymer fibers can be used as light shades for floor lamps, table lamps, pendant lamps, ceiling lamps, wall lamps or other types of lamps or lighting fixtures. The diffusers are aesthetically pleasing and closely simulate the lighting effect obtained when parchment or rice paper is used as a diffuser without suffering from the disadvantages associated with parchment and rice paper. The diffusers are resistant to combustion and moisture, are flexible, crease well, clean easily, resist tears, and are translucent.

It should be understood that, while the preferred embodiment of the invention has been illustrated and described, various changes can be made therein without departing from the spirit and scope of the invention.

The embodiments of the invention in which an exclusive property or privilege is claimed are defined as follows:

1. An article for diffusing light comprising a substantially continuous paper-like layer of aromatic polyamide polymer fibers and an overlapping polyester film.

2. The article of claim 1, wherein the layer of aromatic polyamide polymer fibers ranges in thickness from about 3.0 mils to about 7.0 mils.

3. The article of claim 1, wherein the layer of aromatic polyamide polymer fibers is coated with an ultraviolet light blocking agent.

4. The article of claim 1, wherein the polyester film ranges in thickness from about 5.0 mils to about 10.0 mils.

5. The article of claim 1, further comprising a second overlapping layer of aromatic polyamide polymer fibers, the polyester film being sandwiched between the two layers of the aromatic polyamide polymer fibers.

6. The article of claim 5, wherein each of the two layers of aromatic polyamide polymer fibers are about 3.0 mils thick and the polyester film is about 7.5 mils. thick.

7. A light shade comprising a substantially continuous paper-like layer of aromatic polyamide polymer fibers and an overlapping polyester film.

8. The light shade of claim 7, wherein the polyester film ranges in thickness from about 5.0 mils to about 10.0 mils.

9. The light shade of claim 7, further comprising a second overlapping layer of aromatic polyamide polymer fibers, the polyester film being sandwiched between the two layers of the aromatic polyamide polymer fibers.

10. The light shade of claim 9, wherein each of the two layers of aromatic polyamide polymer fibers is about 3.0 mils thick and the polyester film is about 7.5 mils thick.

11. The light shade of claim 7. wherein the layer of aromatic polyamide polymer fibers ranges in thickness from about 3.0 mils to about 7.0 mils.

12. The light shade of claim 7, wherein the layer of aromatic polyamide polymer fibers is coated with an ultraviolet light blocking agent.

13. A light diffuser mounted on a plurality of support arms positioned around a light source, the light diffuser including identical first, second, third and fourth folded sections, each section comprising a folded substantially continuous paper-like layer of aromatic polyamide polymer fibers, the folded paper-like layer including a plurality of aligned apertures, each aperture capable of receiving and retaining a fastener capable of being attached to a support arm, each folded section including a singular aperture capable of being aligned with the plurality of apertures of an adjacent section.

14. The light diffuser of claim 13, wherein the singular aperture of the first section and the plurality of aligned apertures of the second section are aligned, the first section being fastened to the second section by a fastener means passing through the aligned singular aperture and the plurality of apertures.

15. The light diffuser of claim 13, wherein each of the sections is attached to two adjacent sections.

16. The light diffuser of claim 13, wherein a neoprene plug extends through at least two sections of the light diffuser and onto the end of a support arm.

17. The light diffuser of claim 13, wherein the support arms are positioned uniformly around the light source.

* * * * *